US008459325B2

(12) United States Patent
Faller et al.

(10) Patent No.: US 8,459,325 B2
(45) Date of Patent: Jun. 11, 2013

(54) OPERATING SYSTEM FOR ARCHED COVERING FOR ARCHITECTURAL OPENING

(75) Inventors: Kenneth M. Faller, Thornton, CO (US); Christopher P. Gruner, Firestone, CO (US)

(73) Assignee: Hunter Douglas Inc., Pearl River, NY (US)

( * ) Notice: Subject to any disclaimer, the term of this patent is extended or adjusted under 35 U.S.C. 154(b) by 1318 days.

(21) Appl. No.: 11/749,979

(22) Filed: May 17, 2007

(65) Prior Publication Data

US 2007/0267151 A1 Nov. 22, 2007

Related U.S. Application Data

(60) Provisional application No. 60/747,688, filed on May 19, 2006.

(51) Int. Cl.
*E06B 3/94* (2006.01)

(52) U.S. Cl.
USPC ..... 160/84.05; 160/84.07; 160/134; 160/169

(58) Field of Classification Search
USPC ..... 160/370.22, 134, 84.07, 370.21, 160/84.05, 84.04, 84.06, 168.1 R, 169, 173 R, 160/107
See application file for complete search history.

(56) References Cited

U.S. PATENT DOCUMENTS

| | | | | |
|---|---|---|---|---|
| 4,679,610 | A * | 7/1987 | Spraggins | 160/107 |
| 4,776,380 | A * | 10/1988 | Lester | 160/134 |
| 4,934,436 | A * | 6/1990 | Schnebly | 160/84.07 |
| 5,456,303 | A * | 10/1995 | Horinouchi | 160/84.04 |
| 6,029,733 | A * | 2/2000 | Xue | 160/84.07 |
| 6,684,454 | B2 * | 2/2004 | Ehrenreich | 16/197 |
| 6,758,256 | B1 * | 7/2004 | Garcia | 160/134 |
| 2002/0053409 | A1 * | 5/2002 | Anderson et al. | 160/84.05 |
| 2005/0082859 | A1 * | 4/2005 | Walter et al. | 296/24.4 |
| 2006/0130980 | A1 * | 6/2006 | Gromotka et al. | 160/107 |

* cited by examiner

*Primary Examiner* — Blair M Johnson
*Assistant Examiner* — Jaime F Cardenas-Garcia
(74) *Attorney, Agent, or Firm* — Dorsey & Whitney LLP

(57) ABSTRACT

An operating system for a retractable covering for an architectural opening wherein one edge of the covering is fixed and the opposite edge is movable between extended and retracted positions, includes an endless cord loop having a finger slide that is slidably mounted adjacent to the fixed edge of the covering to effect circulation of the cord loop. Also included in the cord loop is an anchor plate secured to the fabric of the covering adjacent to its movable edge, with the anchor plate also moving with circulatory movement of the cord loop to move the movable edge of the covering between extended and retracted positions. The tension in the cord loop is adjustable through the connection of opposite ends of the cord loop to the finger slide and the routing of the cord loop is directed through cord guides of low friction material so that the entire operation of the covering is smooth and reliable.

6 Claims, 11 Drawing Sheets

OPERATING SYSTEM FOR ARCHED COVERING FOR ARCHITECTURAL OPENING

CROSS REFERENCE TO RELATED APPLICATION

This application claims the benefit under 35 U.S.C. §119 (e) to U.S. provisional patent application No. 60/747,688 ("the '688 application"), which was filed on May 19, 2006 and entitled "Operating System For Arched Covering For Architectural Opening." The '688 application is incorporated by reference into the present application in its entirety.

BACKGROUND OF THE INVENTION

1. Field of the Invention

The present invention relates generally to retractable coverings for architectural openings such as windows, doors, archways and the like and more particularly to an operating system for such a covering.

2. Description of the Relevant Art

Retractable coverings for architectural openings such as windows, doors, archways and the like are well-known in the art and have been in use for many years. Examples of such coverings include curtains, Venetian blinds, vertical blinds, cellular shades and the like. Such retractable coverings typically are movable with an operating system between a retracted position adjacent one or two sides of the architectural opening and an extended position across the architectural opening.

Numerous systems have been employed for reversibly moving coverings between extended and retracted positions. One such system employs a base rail to which an edge of a fabric material is secured, and to which a finger slide is adapted to move linearly. The finger slide anchors one end of two separate operating cords. The opposite ends of the operating cords are anchored to a movable plate positioned adjacent to an opposite edge of the fabric material. The guide cords in combination effectively form an endless loop of cord with the endless loop also slidably passing through a cord reverse bracket anchored to the frame around the architectural opening. In a conventional manner, movement of the finger slide along the base rail in one direction or the other causes the effective endless loop of cord to move in one direction or another, thereby moving the anchor plate and the edge of the fabric between extended and retracted positions of the covering.

As will be appreciated, it is desirable in such systems to retain a predetermined tension in the operating cords as too much slack or too much tension renders the system difficult to operate. In order to adjust the tension in the operating cords, the prior art has provided for adjustment to the location at which the ends of the operating cords are secured to the anchor plate, but if the anchor plate is concealed within the fabric of the covering, such adjustment is difficult to make. Further, routing of the operating cords through the base rail requires reversing directions of the operating cords through sharp angles, and it is thereby difficult to obtain a reliable smooth movement of the operating cords through the base rail. Such operating systems are useful, however, particularly with coverings of nonrectangular configuration such as those having an arched upper edge that is adapted to conform to an arched frame around the architectural opening.

It is to overcome the shortcomings in the prior art and to provide a new and improved operating system for retractable coverings that the present invention has been developed.

SUMMARY OF THE INVENTION

The present invention is an operating system for a retractable covering wherein the covering includes a fixed base rail, a fabric material having an edge secured to the base rail, an opposite edge of the fabric secured to a reversibly movable anchor plate, and wherein the frame around the architectural opening in which the covering is mounted has a fixedly mounted bracket on an opposite side of the frame from the base rail and around which an operating cord can pass. The operating cord causes the anchor plate to move up and down slidably, thereby moving the edge of the fabric material secured thereto toward or away from the base rail, consequently moving the covering between a retracted and extended position. In the retracted position, the fabric material is gathered adjacent the base rail and in the extended position, it is extended across the architectural opening.

The system includes a finger slide movable linearly along the length of the base rail with the finger slide anchoring one end of two separate operating cords whose opposite ends are secured to the anchor plate thereby forming an effectively endless operating cord loop. The cord loop slidably passes through the bracket on the frame which thereby supports the cord loop across the architectural opening. The cord loop is routed through the anchor plate and the base rail before being secured to the finger slide so movement of the finger slide in one direction or the other causes the cord loop to circulate in one direction or another. Of course one direction of circulation causes the anchor plate to move away from the base rail thereby extending the covering and movement of the endless loop in the opposite direction causes the anchor plate to move toward the base rail and therefore toward a retracted position of the covering.

The ends of the operating cords are secured to the finger slide in an adjustable manner so that the tension in the operating cords can be regulated at the finger slide. This is very useful inasmuch as the finger slide, in most installations, is easily accessible and the tension in the operating cords can therefore be easily adjusted. The cord loop, in passing through the base rail, extends through several sharp turns at which it is important they slide freely to assure reliable and smooth operation of the system. At two locations in the base rail, an improved cord guide is anchored to the base rail for purposes to be described hereafter, but which facilitates smooth movement of the cord loop through the base rail.

Accordingly, the operating system of the present invention is easily adjustable to maintain a desired tension in the operating cord loop and enables smooth movement of the cord loop through the base rail for smooth and dependable operation of the system.

Other aspects, features and details of the present invention can be more completely understood by reference to the following detailed description of a preferred embodiment, taking in conjunction with the drawings and from the appended claims.

DESCRIPTION OF THE PREFERRED EMBODIMENT

Figure 1:
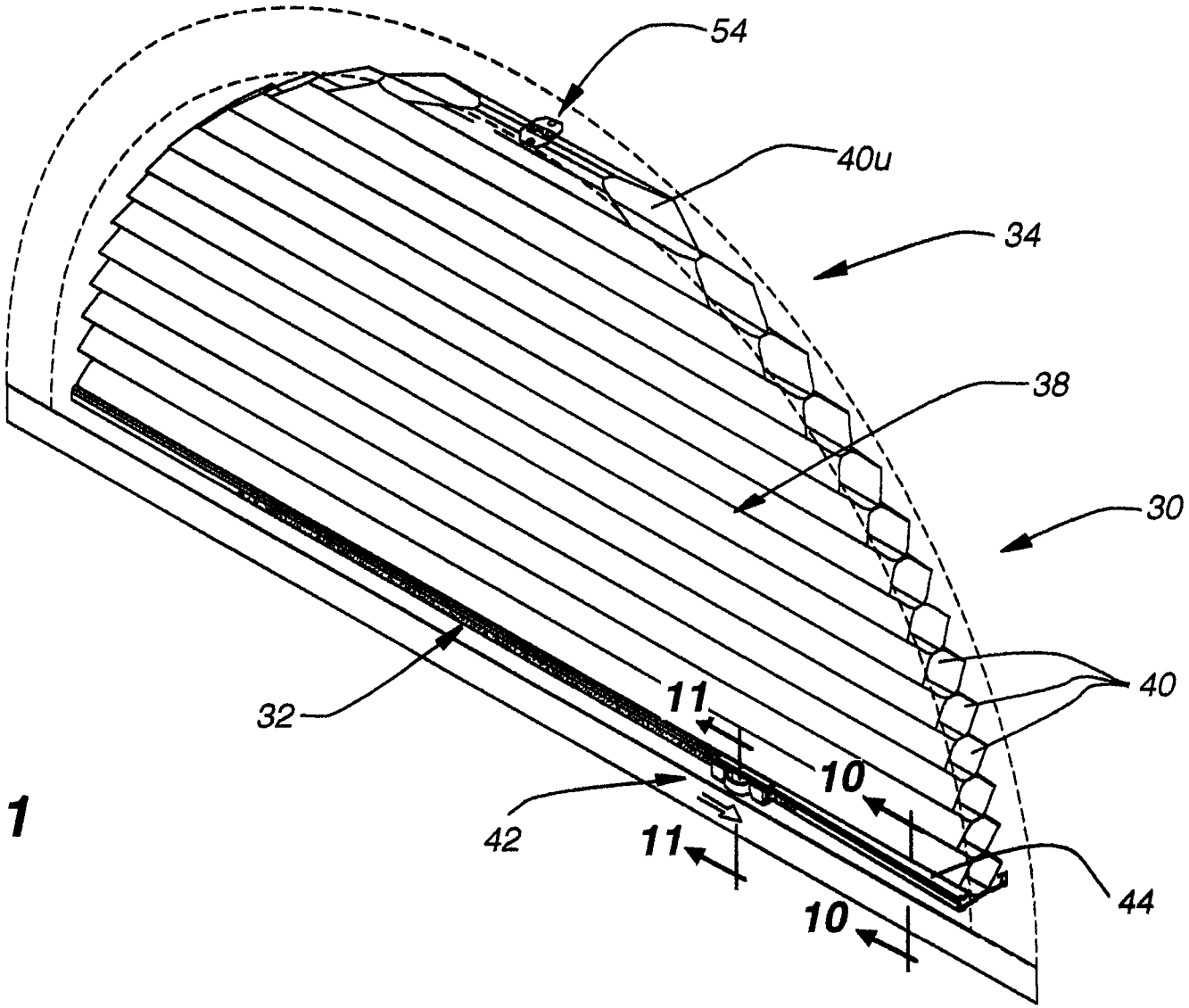
FIG. 1 is an isometric of an arched cellular collapsible covering for an architectural opening incorporating the operating system of the present invention and with a portion of the frame around the architectural opening shown in dashed lines.

FIG. 1 shows a retractable cellular covering 30 for an architectural opening in a fully extended position with the covering employing the operating system of the present invention. As will be appreciated with the detailed description of the operating system hereafter, it is a system that would be useful in many different retractable coverings for architectural openings, but one particular covering in which the system finds unique relevance is a retractable covering of a nonrectangular configuration, such as an arched configuration as illustrated. In an arched opening, the covering, when extended, has an elongated flat bottom 32 and a semicircular top 34 so that the semicircular top conforms and mates with a semicircular frame 36 across the top of the architectural opening. It will be evident that architectural openings of many different sizes and configurations could be fitted with a covering of the general type illustrated. Accordingly, the covering shown is for illustrative purposes only and one in which the operating system of the present invention would find a particularly useful function.

Figure 2:
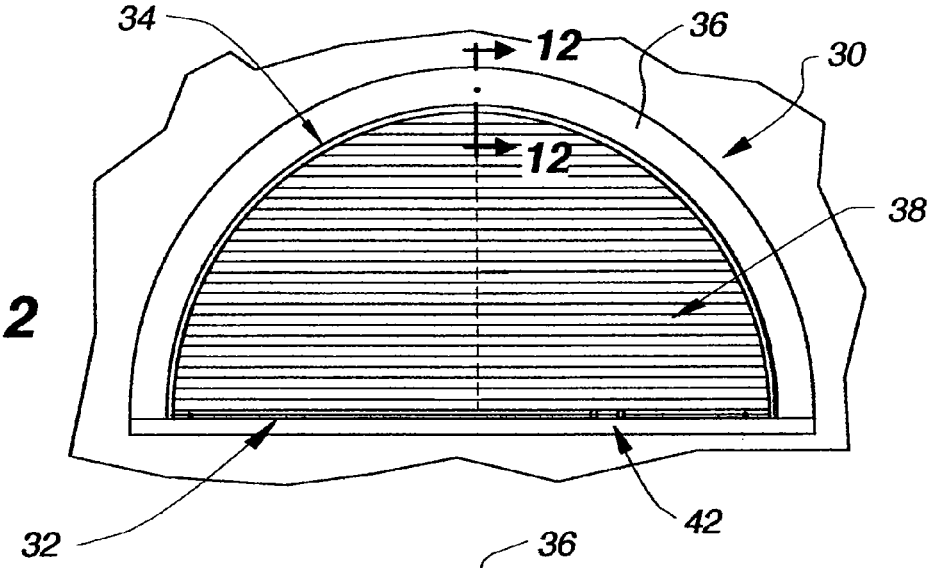
FIG. 2 is a front elevation of the covering of FIG. 1 in a fully extended position.
Figure 3:
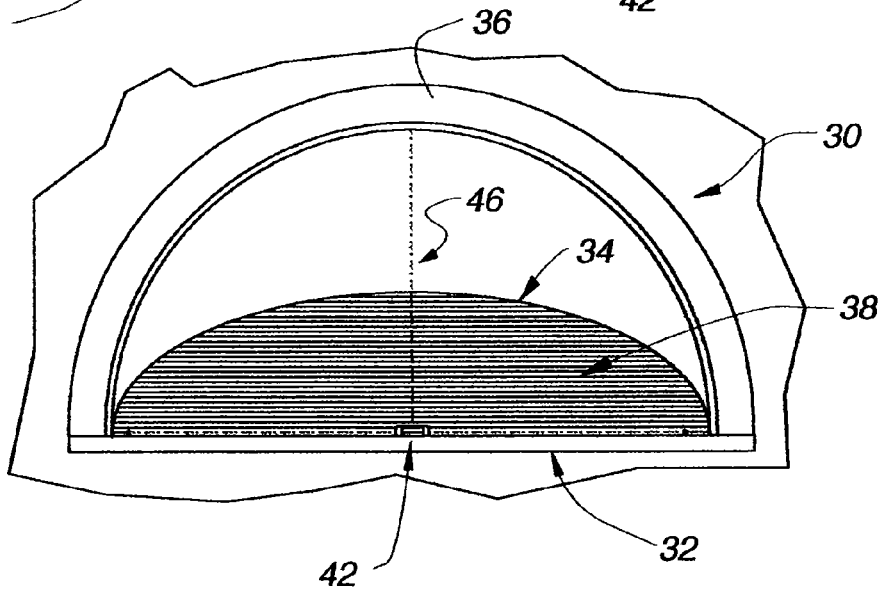
FIG. 3 is a front elevation of the covering of FIG. 1 in a partially extended position.
Figure 4:
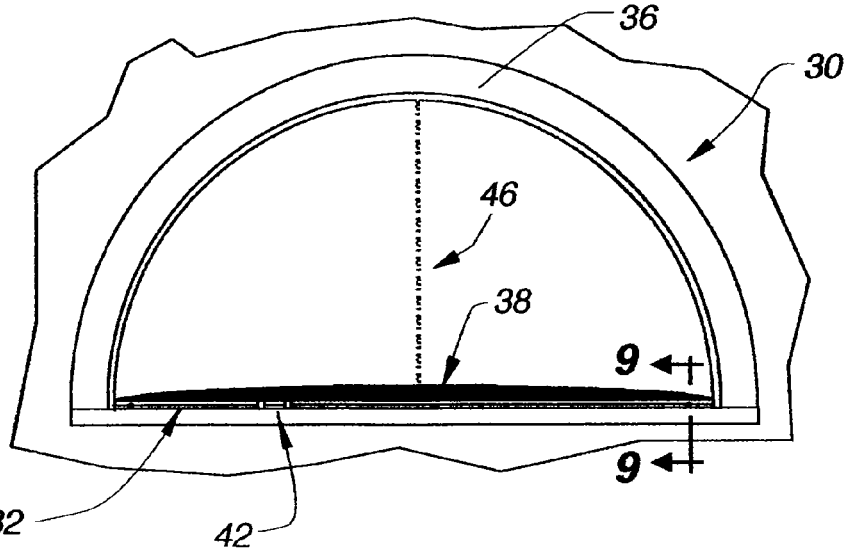
FIG. 4 is a front elevation of the covering of FIG. 1 in a fully retracted position.

FIGS. 2-4 illustrate diagrammatically the operation of the covering 30 which, as mentioned previously for purposes of the present disclosure, includes a fabric material 38 of cellular structure with the cells 40 extending horizontally and being transversely collapsible. As will be appreciated, the horizontal length of the cells from the bottom of the fabric to the top become progressively shorter. With the operating system of the present invention, the fabric material can be reversibly moved from the fully extended position of FIG. 2 through a partially extended position of FIG. 3, to a fully retracted position of FIG. 4. The covering is moved between any desired position with a finger slide 42 along the base 44 of the covering which can be moved from a position toward the right side of the covering wherein the fabric material is fully extended, to a position closer to the left side of the opening where the fabric material is fully retracted as seen in FIGS. 2 and 4, respectively.

Figures 5, 6:
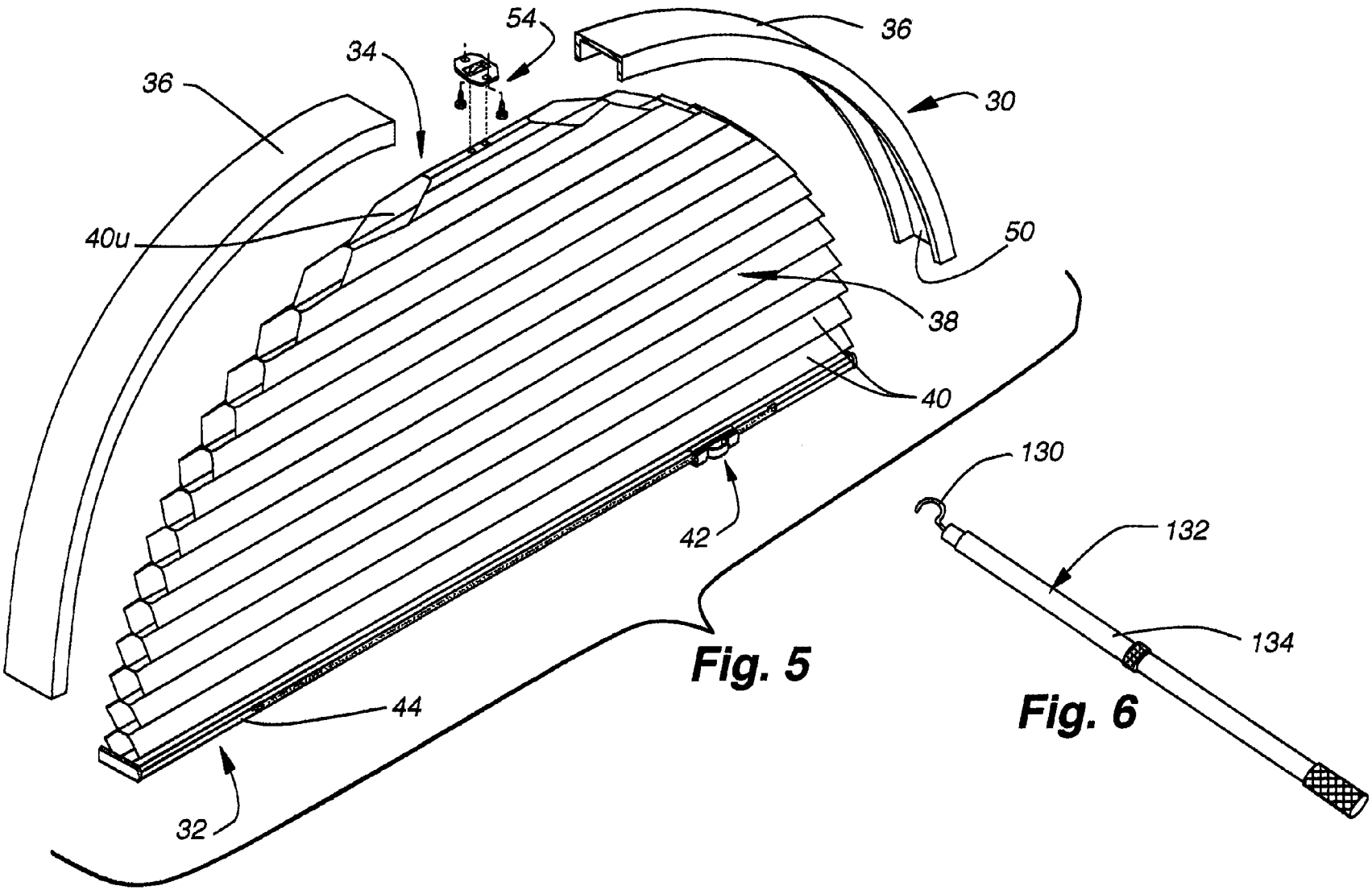
FIG. 5 is an exploded isometric of the covering of FIG. 1.
FIG. 6 is an isometric of a control wand for use in operating the system of the present invention.
Figure 7:
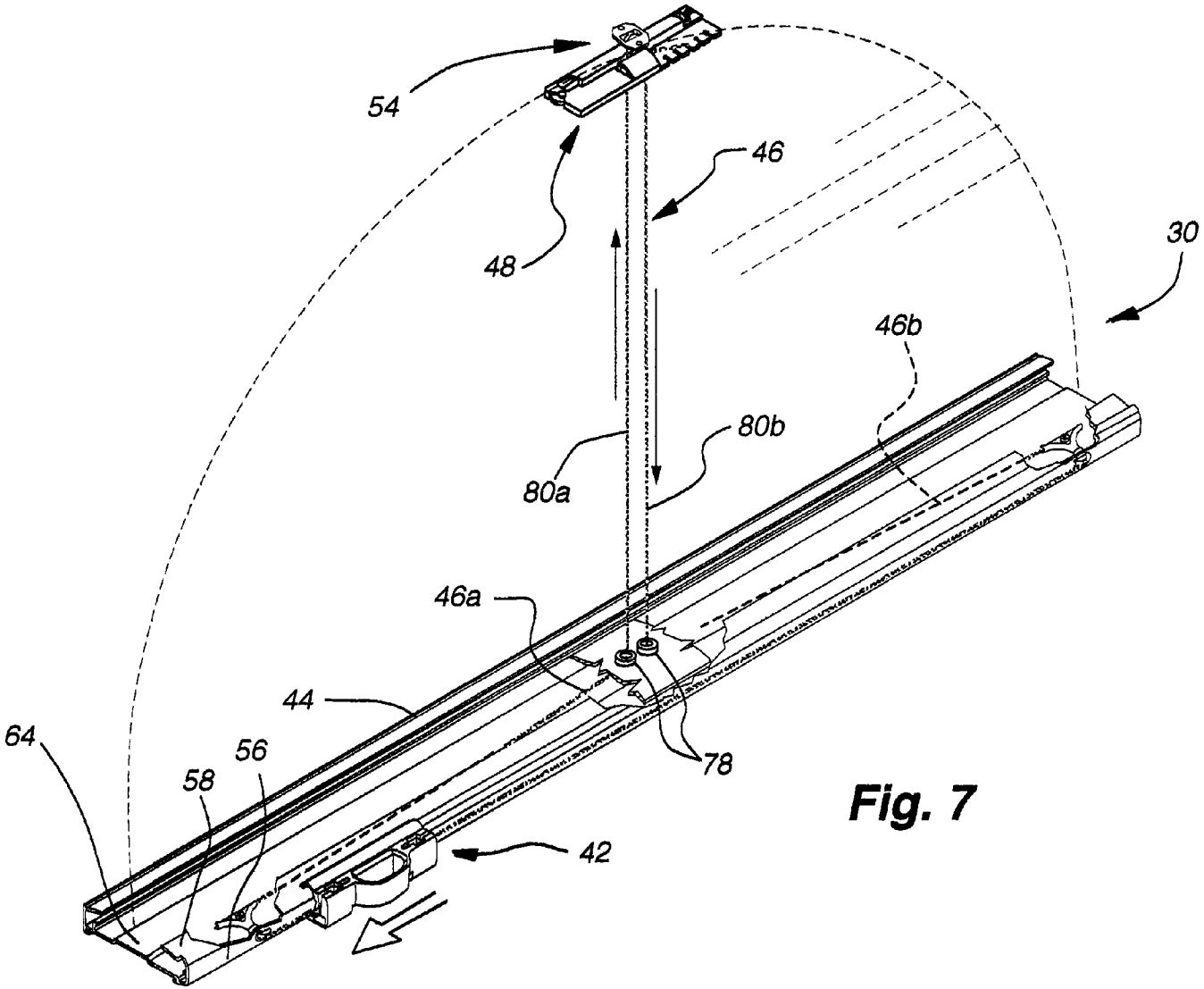
FIG. 7 is an isometric showing the operating system of the present invention when the covering is in the fully extended position of FIG. 2.
Figure 8:
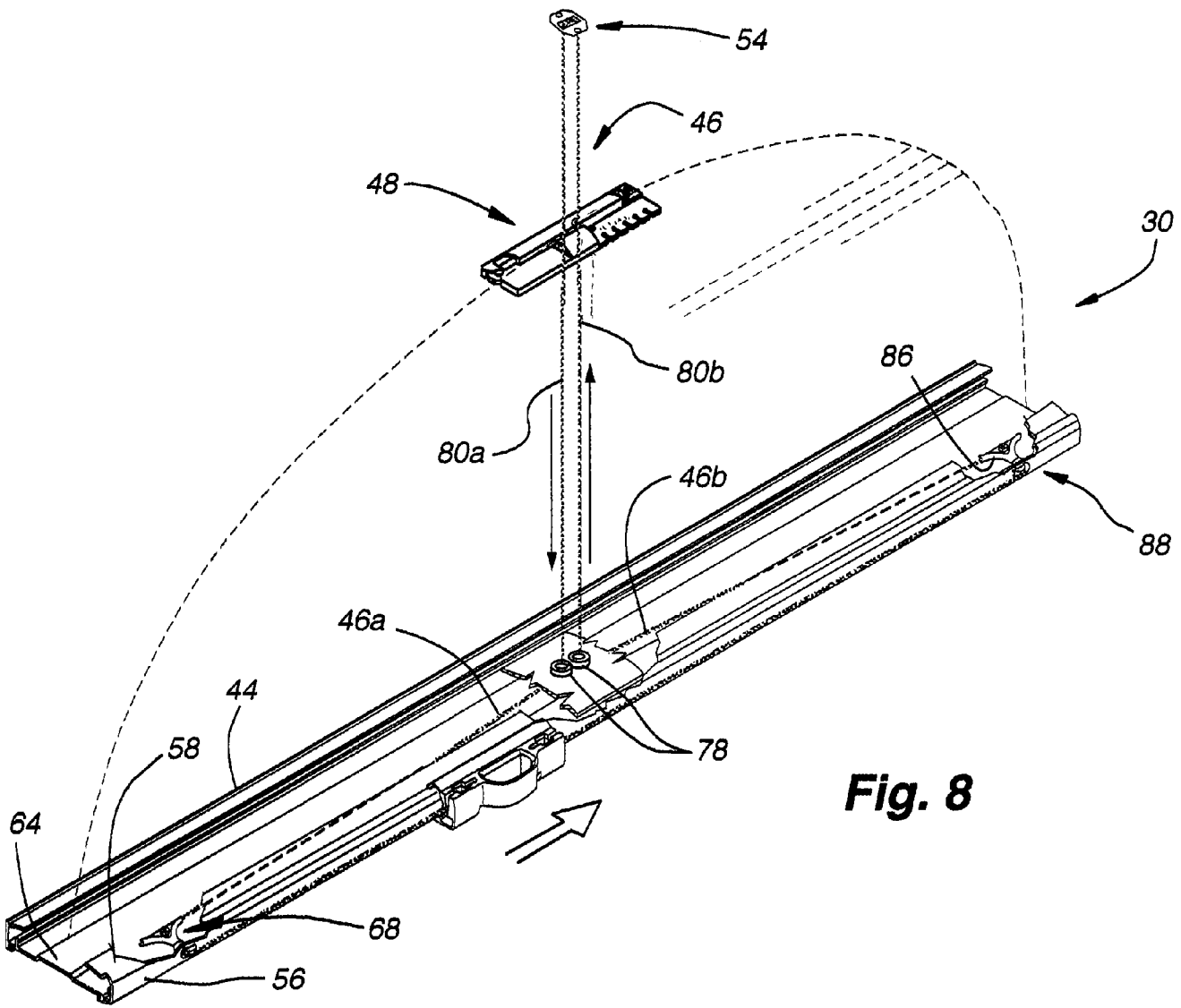
FIG. 8 is an isometric similar to FIG. 7 showing the covering in the partially extended position of FIG. 3.

The components of the covering 30, including the operating system of the present invention, can be seen in FIG. 5 to include the fabric material 38 which has its lowermost cell **40*l* secured to the extruded base rail 44, and the finger slide 42 slidably mounted on the base rail for horizontal movement, with the finger slide anchoring one end of a pair of operating cords 46*a* and 46*b*, whose opposite ends are anchored to an anchor plate 48 positioned centrally within the uppermost cell 40*u* of the cellular fabric material. A pair of arcuate frame members 36 are positionable within the architectural opening so that in aggregate they define a semicircular downwardly opening channel 50 adapted to receive the semicircular top edge 34 of the collapsible fabric material 38 so that the top edge of the fabric material can be concealed within the channel frame members 36 when the covering is fully extended. A reverse cord bracket 54 is also seen in FIG. 5 which is secured within the channel of the frame member at a centrally located position at the top of the architectural opening to slidably support the operating cord 46 for the system, whereby the collapsible fabric material can be elevated or lowered to any desired degree relative to the base rail. FIG. 7 is an isometric similar to FIG. 5 wherein the cellular collapsible fabric material has been removed to more clearly illustrate the components of the operating system of the present invention. FIG. 8 is a similar isometric showing the anchor plate having been lowered from the fully extended position of FIG. 7 to a partially extended position in FIG. 8**.

Referencing particularly FIGS. 7-11, the base or bottom rail 44 of the operating system can be seen to be an upwardly opening channel member, preferably of an extruded formation, and can be made of aluminum, plastic or other suitable material that is rigid in nature. The front edge 56 of the bottom rail is somewhat bulbous in transverse configuration as possibly seen best in FIGS. 9-11, to provide an arcuate upwardly projecting top rib 58 and a lower rearwardly projecting elongated lip 60 that defines a channel 62 between a bottom wall 64 of the base rail and the lip 60. As will be better appreciated with the description that follows, the curved front edge 56 of the base rail, the arcuate top rib 58 and the rearwardly opening channel 62 complement in configuration a rearwardly opening groove 66 in the finger slide 42 so the finger slide can be slid linearly along the length of the base rail in operating the system of the present invention.

Immediately rearwardly from the rounded top rib 58 of the base rail 44 is an upwardly and rearwardly projecting shelf 68 that confronts in spaced relation a similar upwardly and forwardly projecting shelf 70 of a rear wall 72 of the base rail. Between the shelves is an elongated opening 74 into which the fabric 38 of the present invention can extend. The lowermost cell 401 of the fabric material is positioned within the base rail 44 and is held beneath the shelves 70 and 72 with a semi-rigid or rigid anchor strip 76 that is inserted into the lowermost cell beneath the shelves. The remaining cells in the fabric material are positioned above the shelves and can rest thereon when the covering is in the fully retracted position of FIG. 3 or 9. As best seen in FIGS. 7 and 8, at a central position along the length of the anchor strip 76, a pair of longitudinally aligned grommets 78 are mounted in the anchor strip to provide passages therethrough with the grommets serving to be aligned with and slidably receiving the operating cords 46*a* and 46*b* as will be described hereafter. Accordingly, the grommets are made of a material having a low coefficient of friction, such as nylon, plastic or the like.

Again referencing FIGS. 7 and 8, the operating or control cords 46*a* and 46*b* for the system each having a lower end anchored in the finger slide 42 and an upper end anchored to the anchor plate 48. The control cord segments 46*a* and 46*b* in combination thereby form an endless cord loop 46 with the finger slide and anchor plate forming a part of the loop. The cord loop has two vertical runs 80*a* and 80*b* extending across the architectural opening which move in opposite directions depending upon the direction of circulation of the cord loop. As will be appreciated with the description that follows, the cord loop is only anchored to the anchor plate along vertical run 80*b* so that the anchor plate moves up and down with that run while the other vertical run 80*a* of the cord loop slides through the anchor plate. The uppermost extent of the cord loop is slidably supported by the reverse cord bracket 54 anchored to the underside of the arcuate frame 36 so that the cord loop can cycle or circulate in one direction or another raising and lowering the anchor plate accordingly as the finger slide is moved linearly along the length of the base rail.

As will be appreciated, in order that the finger slide 42 effect circulating movement of the cord loop 46, the operating cord segments 46*a* and 46*b*, upon entering the base rail 44 through the grommets 78 and holes 82 provided in the bottom wall 84 of the lowermost cell 40*l* of the fabric material 38, extend in opposite directions along the length of the base rail. Each cord segment passes in an opposite direction in the base rail and is fed into one arm 86 of an associated bifurcated cord guide 88 that is anchored to the bottom wall 64 of the base rail as seen best in FIGS. 9 and 10. The cord guides are identical and include a base 90 and a removable end cap 92 with the removable cap having an arched surface 94 around which the associated cord segment of the cord loop can slidably pass so that the direction of the cord segment is reversed and extends toward an associated end of the finger slide 42. The cord guide 88 will be described in more detail hereafter but suffice it to say it functions as a relatively friction-free means by which the direction of the operating cord can be reversed.

Figure 9:
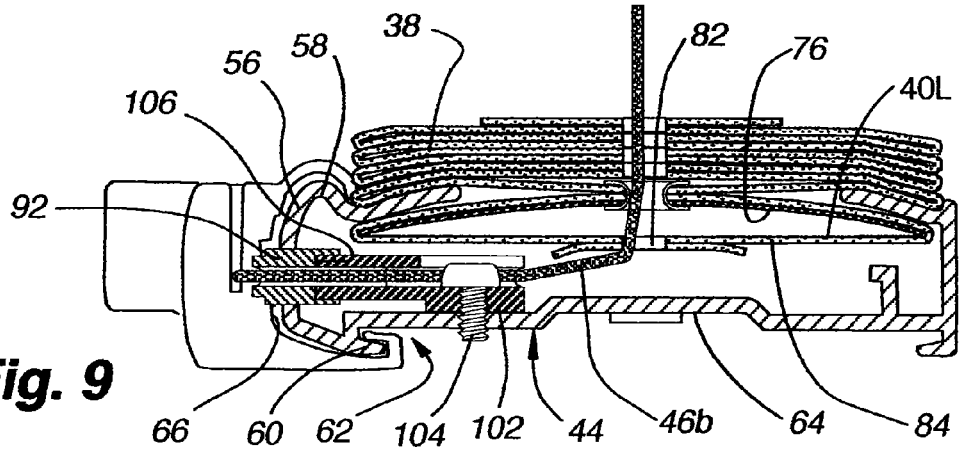
FIG. 9 is an enlarged section taken along line 9-9 of FIG. 4.
Figure 10:
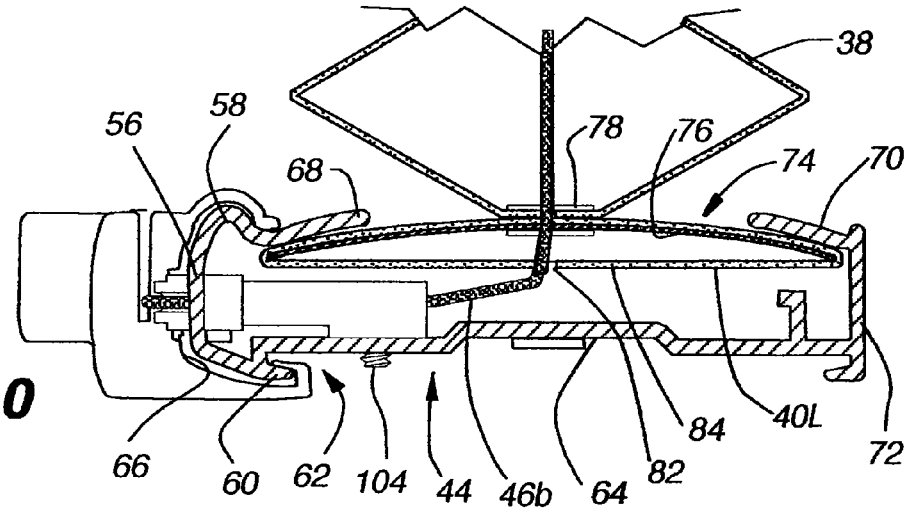
FIG. 10 is an enlarged section taken along line 10-10 of FIG. 1.
Figure 11:
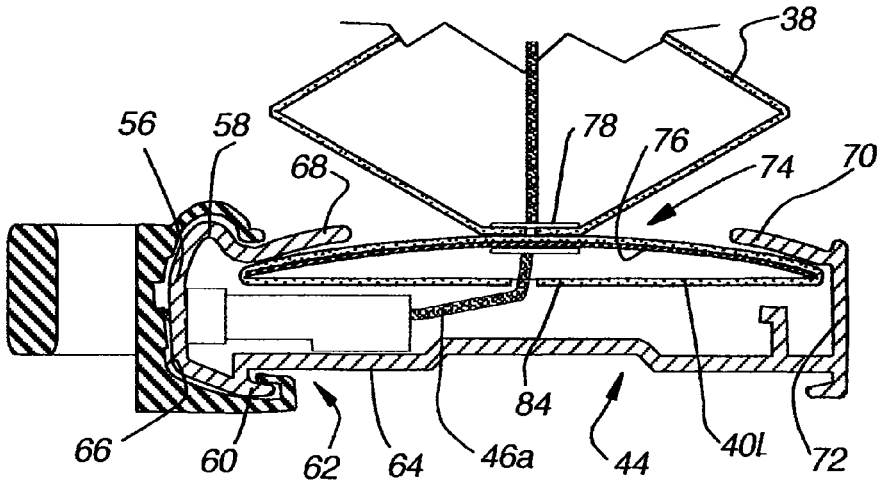
FIG. 11 is an enlarged section taken along line 11-11 of FIG. 1.
Figure 12:
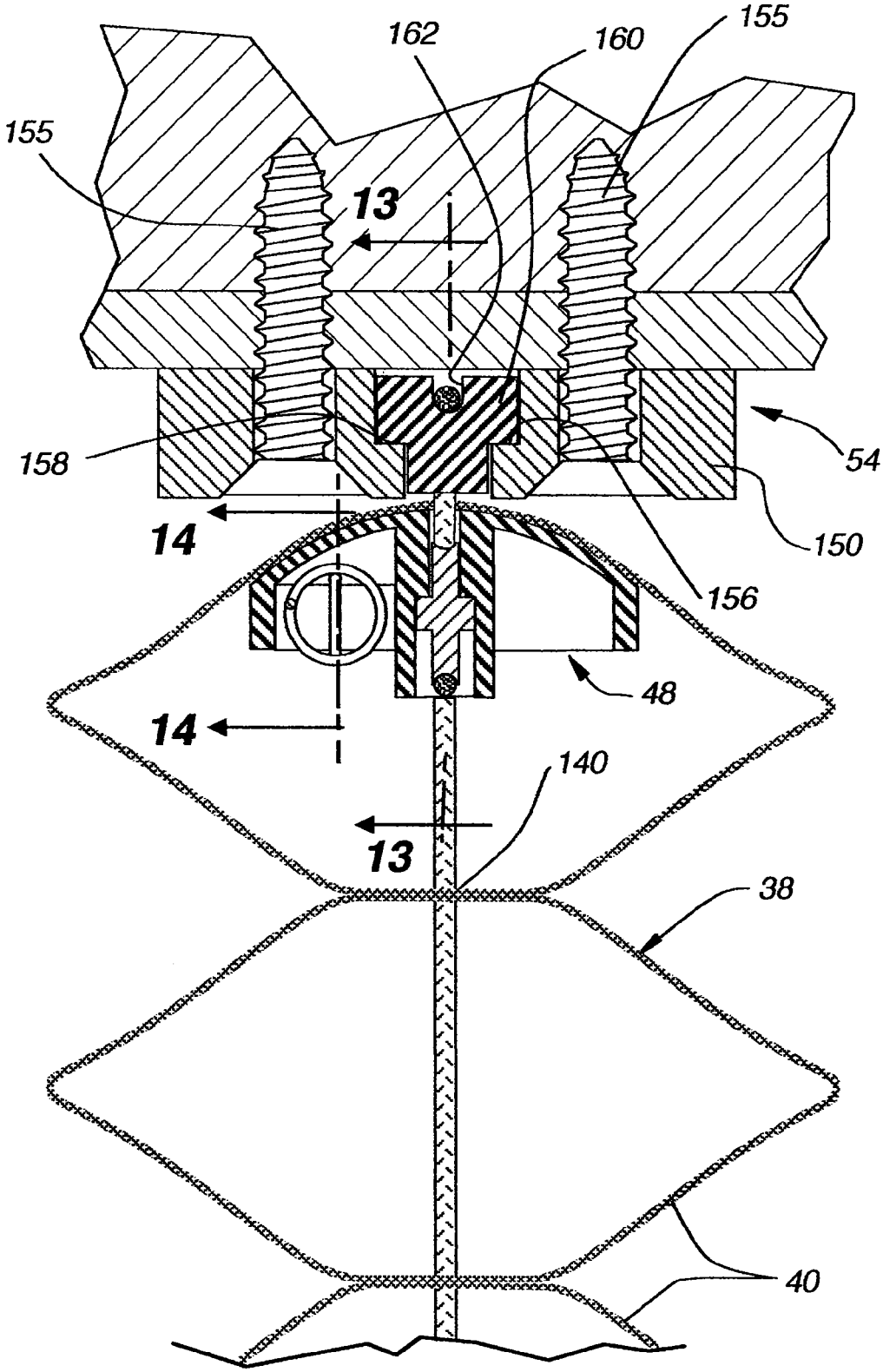
FIG. 12 is an enlarged fragmentary section taken along line 12-12 of FIG. 2.
Figures 17, 18:
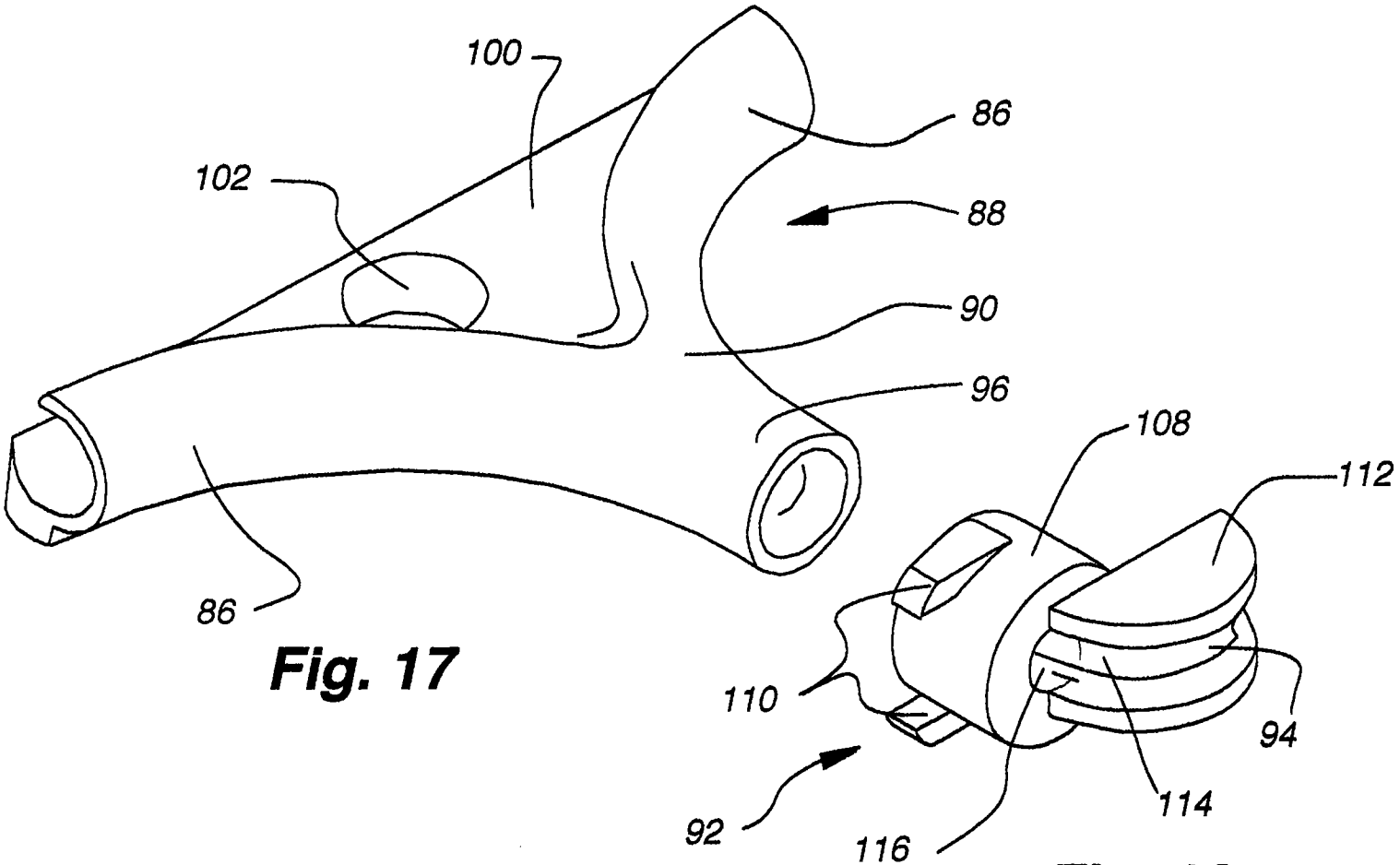
FIG. 17 is an isometric of the base component of the cord guide used in the operating system of the present invention.
FIG. 18 is an isometric of the end cap that mounts on the base of the cord guide shown in FIG. 17.
Figure 19:
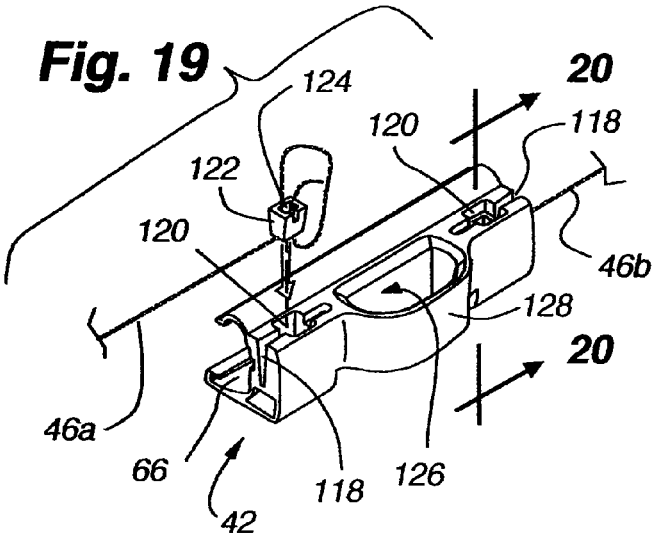
FIG. 19 is an isometric of the finger slide used for operating the system of the present invention with a cord anchor shown in an exploded position.
Figure 20:
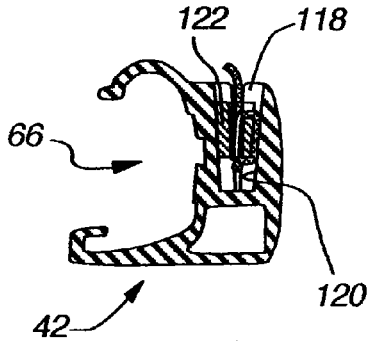
FIG. 20 is an enlarged section taken along line 20-20 of FIG. 19.
Figure 21:
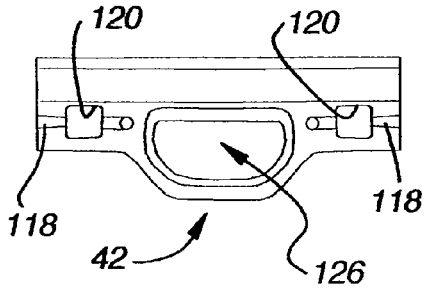
FIG. 21 is a top plan view of the finger slide of FIG. 19.
Figure 24:
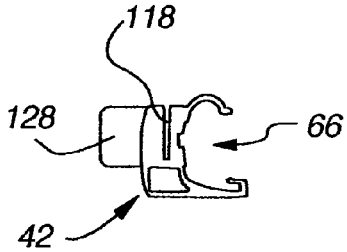
FIG. 24 is a right end elevation of the finger guide of FIG. 20.
Figure 22:
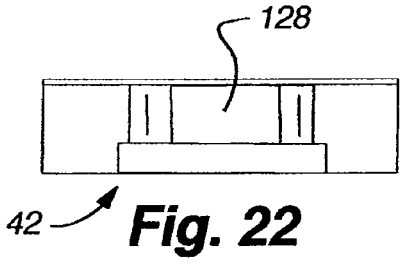
FIG. 22 is a front elevation of the finger slide of FIG. 19.
Figure 23:
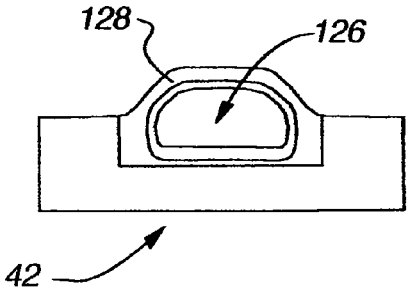
FIG. 23 is a bottom plan view of the finger guide of FIG. 19.

With reference to FIGS. 9, 10, 17 and 18, the cord guide 88 is best illustrated. The base component 90 of the cord guide as seen in FIG. 17 is bifurcated so as to have a hollow cylindrical main trunk 96 and two hollow diverging arms 86 which open in opposite directions that are parallel to the length of the base rail 44 when the base component of the cord guide is secured to the base rail. A gusset 100 extends integrally between the two arms having a vertical hole 102 therethrough to receive a fastener 104 as seen in FIGS. 9 and 10 that secures the base component to the base rail at a desired location along the length of the base rail. As appreciated by reference to FIGS. 7 and 8, there are two cord guides each positioned near an end of the base rail. The two arms in the base component are provided so that the base component is interchangeable and can be used at either end of the base rail even though an operating cord segment only extends through one arm of a cord guide and out through the main trunk of the cord guide.

The main trunk 96 is sized to frictionally receive a cylindrically recessed seat 106 (FIG. 9) in the end cap 92 which has a cylindrical body 108 in which the cylindrical recess is formed. A pair of tangential fingers or tabs 110 is formed on the outer cylindrical surface of the body 108 so as to abut an inner surface of the base rail 44 as seen in FIG. 10 to prevent pivotal movement of the cap on the base component 90 of the cord guide 88. This keeps a desired alignment of a semicircular arcuate segment 112 of the end cap with the length of the base rail. The arcuate segment has the smooth arcuate semicircular grooved surface 94 formed thereon over which a cord segment can slidably pass. One end of the smooth groove 114 is in contiguous alignment with a circular passage 116 through the cylindrical main body of the cap so that the cord can pass through one arm of the base component, through the main trunk, through the cylindrical portion of the cap, and around the arcuate grooved surface and thereby be directed in an opposite direction from which it entered the cord guide and correspondingly toward the finger slide 42 which is positioned between the cord guides at the opposite ends of the base rail. The cord guide is made of a low friction material such as nylon, plastic or the like, to provide a near non-friction surface on which the cord loop can slide. This reduces the friction generated by the cord loop in the operation of the system so that the operating system is smooth and dependable even when the direction of the operating cord is reversed.

With reference to FIGS. 7, 8 and 19-23, the finger slide 42 and its operative connection to the operating cord segments 46*a* and 46*b* is illustrated. The finger slide as seen best in FIGS. 19-23 is an elongated body having the previously described longitudinal groove 66 in the rear thereof adapted to slidably receive the front edge 56 of the base rail 44 so that the finger slide can be retained on but easily slid along the length of the base rail. The finger slide has a vertical v-shaped notch 118 that opens through the top thereof formed in each end with a downwardly tapered rectangular blind hole 120 formed in cooperation therewith. The blind hole releasably receives an anchor plug 122 as seen best in FIG. 19 with the plug having a vertical passage 124 therethrough so that the lower end of an associated cord segment 46*a* or 46*b* can be looped through the passage prior to the plug being inserted into the blind hole where the plug is retained by friction, thereby anchoring the lower end of the cord to an associated end of the finger slide. As will be appreciated with this system for connecting a cord segment to the finger slide, the cord segment can be secured to the anchor plug at any location along the length of the cord segment so that if tension were desired to be added to or removed from the cord loop it could be accomplished by adjustment of the location of the attachment of either cord segment to its associated anchor plug.

At a centered location on the finger slide 42, a large vertical hole 126 extends through the finger slide to define a handle 128 which can be easily gripped by the fingers of an operator of the system or by the hooked end 130 of a control wand 132 as shown in FIG. 6. The control wand could be an elongated or even extensible rod 134 with a hook on the end 130 for cooperation with the handle 128 on the finger slide. This would only be necessary if the finger slide were at an unreachable location for an operator such as at an elevated height.

It will be appreciated from the above the finger slide 42 can be slidably moved along the length of the head rail while pulling one end of one cord segment 46*a* or 46*b* and allowing the corresponding end of the other cord segment 46*a* or 46*b* to move in the same direction. As mentioned previously, the two cord segments effectively form an endless loop 46 of which the finger slide forms part so that movement of the finger slide linearly along the length of the base rail 44 causes the endless loop to circulate in one direction or another thereby extending or retracting the shade as described previously.

Referring next to FIGS. 7, 8, and 12-16, the anchor plate 48 is best illustrated which, as mentioned previously, is secured to one vertical run 80*b* of the endless cord loop 46 while allowing the other vertical run 80*a* of the endless cord loop to slide therethrough so that the anchor plate can be moved up and down with circulatory movement of the endless cord loop thereby raising or lowering the top edge 40*u* of the fabric 38 of the covering 30 to which the anchor plate is secured.

Figure 13:
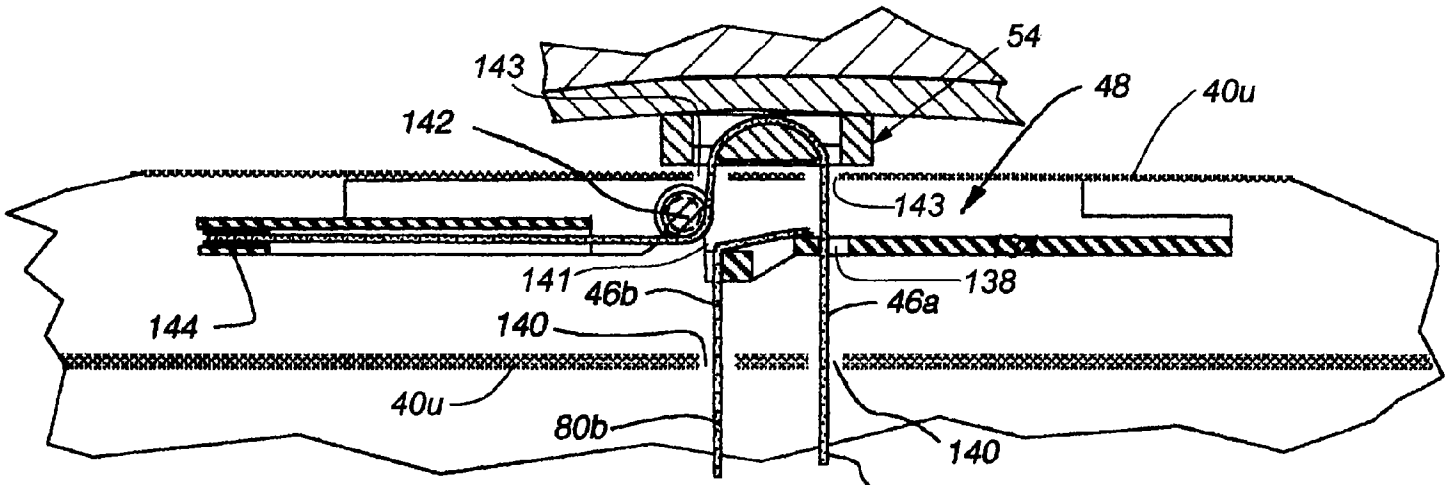
FIG. 13 is a section taken along line 13-13 of FIG. 12.
Figure 14:
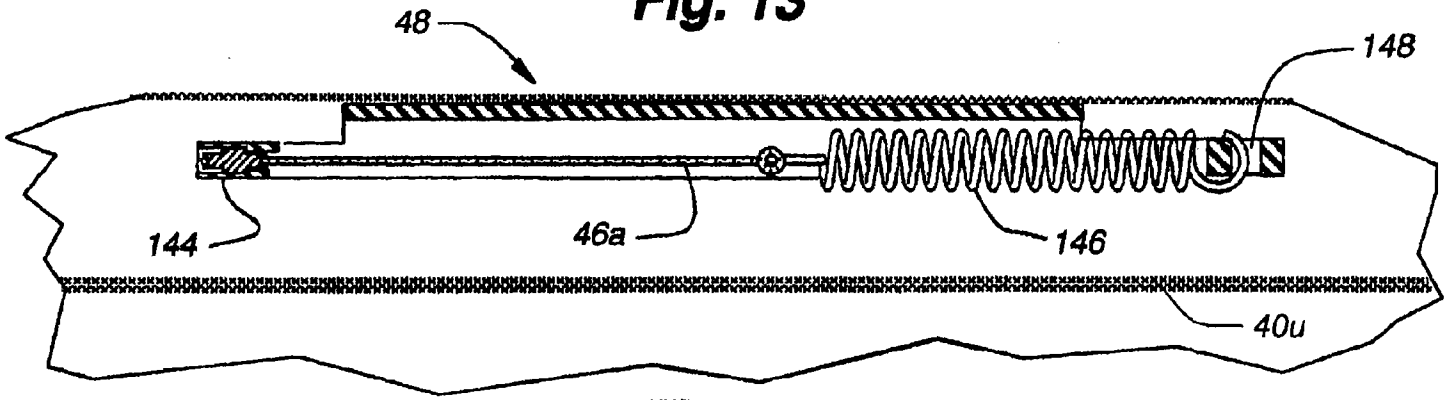
FIG. 14 is a section taken along line 14-14 of FIG. 12.
Figure 15:
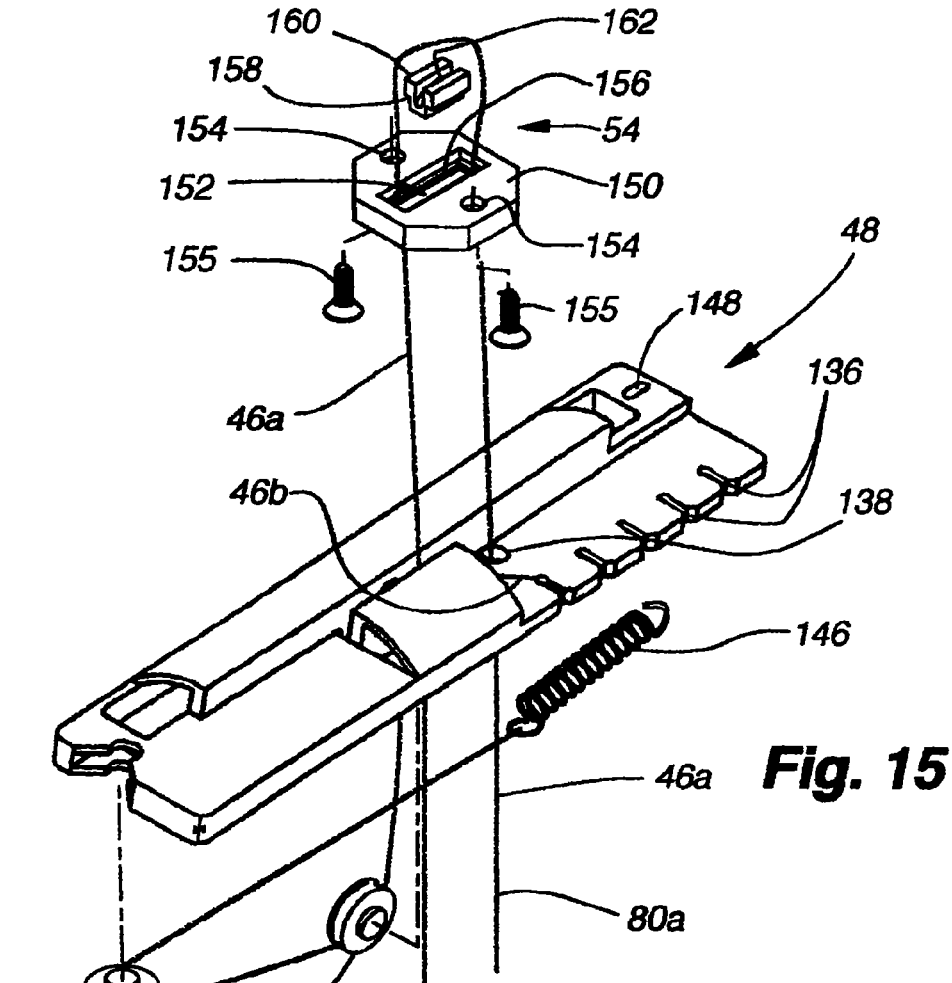
FIG. 15 is an exploded isometric of the anchor plate and cord reverse bracket of the system of the present invention.
Figure 16:
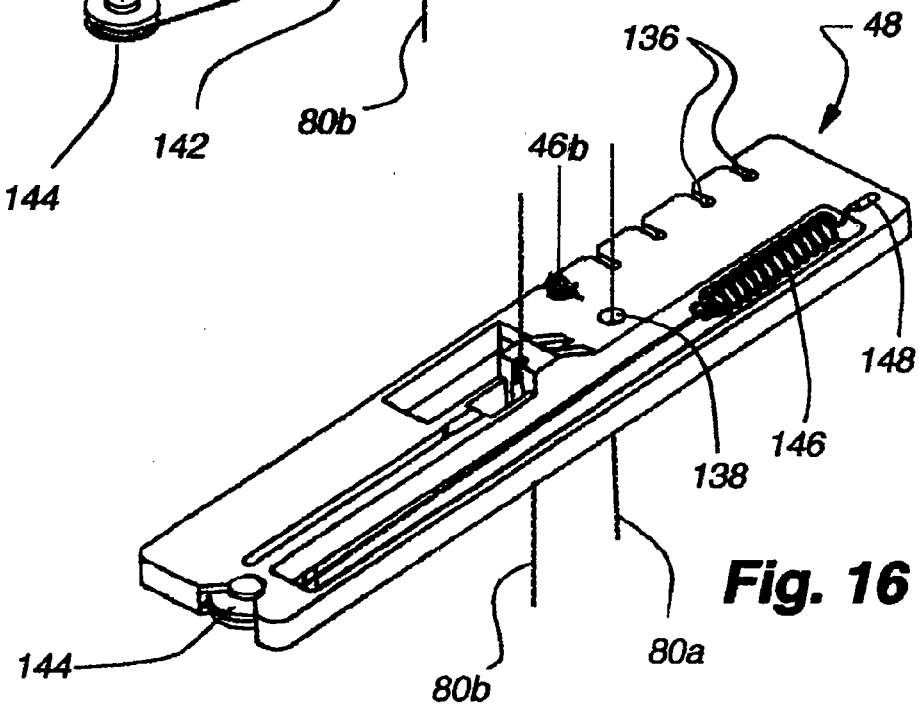
FIG. 16 is an isometric looking at the bottom of the anchor place of FIG. 15.

With reference to FIGS. 15 and 16, the anchor plate 48 can be seen to be a generally flat elongated plate-like member which can be inserted into the uppermost cell 40*u* of the cellular fabric 38 as probably appreciated best in FIGS. 13 and 14. In FIG. 15, however, the generally flat plate-like member can be seen to include a plurality of longitudinally-spaced notches 136 formed in one longitudinal edge of the plate adjacent to a hole 138 passing vertically through the plate. As mentioned previously, both cord segments 46*a* and 46*b* of the cord loop 46 have an upper end thereof secured to the anchor plate and one of the segments 46*b* passes upwardly through one of two holes 140 in the uppermost cell 40*u*, then through a hole 141 before extending across the top of the plate and down through one of the notches 136 (FIG. 15) before the end of the cord is knotted for retainment in a notch 136. It will therefore be appreciated the vertical run 80*b* of the endless cord loop 46 is secured to the anchor plate.

The other segment 46*a* of the endless cord loop 46 as seen best in FIGS. 13, 15 and 16 (which correlates with the vertical run 80*a*), extends upwardly through the hole 138 in the plate and then further through one of two holes 143 through the uppermost cell 40*u* of the fabric 38 before extending into and over the reverse cord bracket 54 at the top of the frame 36. The cord segment 46*a* coming out of the bracket is directed downwardly and extends around a first pulley 142 in the anchor plate 48 that is freely rotatable about a horizontal pivot axis. The cord segment 46*a*, after extending partially around the pulley 142, extends longitudinally of the anchor plate toward the end opposite that having the notches 136 where it passes around a second pulley 144 having a vertical pivot axis and, subsequently, in a reverse direction toward the opposite end of the anchor plate where it is secured to one end of a coil spring 146 whose opposite end (as best seen in FIG. 16) is anchored in a hole 148 provided through the anchor plate at the end adjacent to the notches 136. As will be appreciated, the cord segment 46*a* of endless cord loop 46 is also secured to the anchor plate, but in a resilient manner so as to have some give determined by the strength of the coil spring. This, of course, is determined by the desired tension for the endless cord loop in a smooth and reliable operation of the system. It will also be appreciated from the above, that the anchor plate follows the movement of the vertical run 80*b* of the endless cord loop 46 so that as the vertical run goes up or down, so does the anchor plate. The vertical run 80*a*, of course, is moving in the opposite direction of the vertical run and goes up or down at the same rate so that the anchor plate is permitted to move up or down depending on the direction of circulation of the cord loop as determined by the linear movement of the finger slide 42.

The reverse cord bracket 54 that was mentioned previously is anchored to the frame 36 for the architectural opening at a centered location at the top thereof and has a base plate 150 with a rectangular opening 152 formed therethrough in alignment with the longitudinal dimension of the anchor plate 48. The base plate also has a pair of circular openings 154 for receipt of fasteners 155 used to secure the base plate to the frame of the architectural opening. A peripheral inwardly directed shelf 156 is provided in the rectangular opening adapted to receive shoulders 158 of a slide block 160 having an arcuate groove 162 formed between the shoulders. The arcuate groove is adapted to slidably receive the cord loop 46 while the shoulders are adapted to be seated on the peripheral shelf 156. Accordingly, the slide block is preferably made of a low friction material such as nylon, plastic or the like while the base plate for the bracket can be made of any suitable material such as metal, plastic, nylon or the like.

It will be appreciated from the above that an operating system for a retractable covering of the type having one edge secured to a side of an architectural opening and the opposite edge movable toward and away from the secured edge to retract or extend the covering, has been described. The operating system includes an endless cord loop 46 formed from two cord segments 46*a* and 46*b* with the two cord segments having one end secured to a finger slide 42 mounted on a base rail 44 and the opposite end secured to an anchor plate 48. The anchor plate is secured to a retractable fabric 38 along a movable edge while the opposite or fixed edge of the fabric is secured to the base rail along which the finger slide can move linearly. The cord loop is supported at the top of the architectural opening with a bracket 54 through which the cord can slidably pass whereby movement of the finger slide in one linear direction or another along the length of the base rail causes the endless cord loop to circulate so that the anchor plate moves up and down accordingly to raise and lower the movable edge of the fabric material between extended and retracted positions of the covering. The ends of the cord segments 46*a* and 46*b* forming the cord loop 46 are anchored to the finger slide in an adjustable manner and since the finger slide is exposed, the tension in the cord loop can be adjusted by the location at which the cord segments are attached to the finger slide.

The system also includes cord guides 88 mounted in the bottom rail 44 so that the direction of cord movement of the cord segments 46*a* and 46*b* can be reversed with minimal friction allowing the cord loop to circulate upon easy sliding movement of the finger slide.

Although the present invention has been described with a certain degree of particularity, it is understood the disclosure has been made by way of example, and changes in detail or structure may be made without departing from the spirit of the invention as defined in the appended claims.

The invention claimed is:

1. A retractable covering for an architectural opening comprising in combination: a retractable material having a fixed edge and an opposite movable edge, a rail secured to said fixed edge of the material at one side of said opening, a slide mounted on said rail for slidable movement therealong, an anchor plate secured to said material at or near said movable edge and centered on said movable edge for movement with said movable edge, a flexible cord system operatively secured to said anchor plate and said slide, a fixed bracket at a side of said opening opposite said one side supporting said cord system for movement therearound, said cord system having first and second portions extending respectively in opposite directions from said slide in parallel relationship with said rail toward opposite ends of said rail, said first and second portions reversing direction so as to extend parallel to said rail toward a longitudinal center of said rail and then extending perpendicularly from said rail along said retractable material toward said movable edge, said first portion slidably passing through said anchor plate and then extending further to said fixed bracket where it extends around said fixed bracket and then extends in a reverse direction back to said anchor plate where it is secured to said anchor plate, said second portion having an end secured to said anchor plate, one of said first and second portions being adjustably secured to said anchor plate for selectively adjusting the tension in said cord system, whereby movement of said slide along said rail causes said movable edge to move toward or away from said fixed edge.

2. The covering of claim 1 wherein said cord system is made up of two distinct cord elements, each cord element including one end adjustably secured to said slide and an opposite end secured to said anchor plate to establish a closed loop including said cord elements, said slide and said anchor plate.

3. The covering of claim 2 wherein at least one of said cord elements is resiliently connected to said anchor plate.

4. The covering of claim 3 wherein the other of said cord elements is adjustably connected to said anchor plate.

5. The covering of claim 2 wherein said cord elements are secured to said slide with a plug that is selectively positionable along the length of an associated cord element and removably seated at a fixed location on said slide.

6. The covering of claim 1 wherein said retractable material includes a plurality of interconnected horizontally extending cells and wherein said anchor plate is positioned in one of said cells adjacent to said movable edge of said material.

* * * * *